US007029294B2

(12) United States Patent
Vogel et al.

(10) Patent No.: US 7,029,294 B2
(45) Date of Patent: Apr. 18, 2006

(54) ENCLOSED ELECTRICAL CONNECTOR WITH ISOLATOR FOR SHIELDED CABLES

(75) Inventors: Thomas Vogel, Griesheim (DE); Manfred Goebel, Kostheim (DE)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/782,190

(22) Filed: Feb. 19, 2004

(65) Prior Publication Data

US 2005/0186814 A1 Aug. 25, 2005

(51) Int. Cl.

| | |
|---|---|
| ***H01R 4/66*** | (2006.01) |
| ***H01R 13/648*** | (2006.01) |
| ***H01R 11/22*** | (2006.01) |
| ***H01R 13/11*** | (2006.01) |

(52) U.S. Cl. ..... 439/98; 439/96; 439/851

(58) Field of Classification Search ..... 439/96, 439/98, 842, 843, 847, 851

See application file for complete search history.

(56) References Cited

U.S. PATENT DOCUMENTS

| | | | | |
|---|---|---|---|---|
| 5,934,937 | A * | 8/1999 | McCarthy | 439/583 |
| 6,386,915 | B1 * | 5/2002 | Nelson | 439/584 |
| 6,482,049 | B1 * | 11/2002 | Swearingen | 439/843 |
| 6,837,756 | B1 * | 1/2005 | Swearingen et al. | 439/843 |
| 2004/0003498 | A1 * | 1/2004 | Swearingen et al. | 29/862 |

* cited by examiner

*Primary Examiner*—Chandrika Prasad
(74) *Attorney, Agent, or Firm*—Harness, Dickey & Pierce, P.L.C.

(57) ABSTRACT

A shielded cable assembly that receives a shielded cable therein and includes an isolator or spacer block having a bore and a spring having a fixed portion disposed about the isolator and a resilient portion extending into the bore. A housing retains the isolator and receives the shielded cable. The fixed portion of the spring is in pressed contact with an internal surface of the housing and the resilient portion of the spring is in pressed contact with a shield ring of the shielded cable to scrape the internal surface upon reception into the housing to remove a non-conductive oxide layer formed on the internal surface.

17 Claims, 3 Drawing Sheets

ENCLOSED ELECTRICAL CONNECTOR WITH ISOLATOR FOR SHIELDED CABLES

FIELD OF THE INVENTION

The present invention relates to cable connections, and more particularly to cable improved cable connections for shielded cables.

BACKGROUND OF THE INVENTION

Vehicles require electrical connections to transfer electric power to various systems. In particular, electric, hybrid and fuel cell powered vehicles require electrical connections with operating voltage ranges of 60–1000 VDC, further called "high-voltage". Shielded high-voltage electrical connections are preferred for reducing conducted and reflected emissions. Use of a shielded connection reduces or eliminates the need for electromagnetic interference (EMI) filters which increase cost and complexity of the system.

Traditional electrically shielded connections are overly complex and are difficult to assemble. In the case of shielded wire cables carrying typically 200A or more, there is nothing suitable which is presently available for vehicle applications. Such electrical connectors are required for electric powered vehicles. Currently, only costly, labor intensive, connectors are available.

SUMMARY OF THE INVENTION

The present invention provides an electrical connection for a shielded cable. The electrical connection includes an isolator or spacer block having a first bore and a spring. The spring has a fixed portion attached to the isolator and has a resilient portion extending into the first bore. A housing retains the spacer block, wherein the fixed portion is in pressed contact with an internal surface of the housing.

In one feature, the housing further includes a second bore and the spacer block further includes a stem through which the first bore is formed. The stem is received into the second bore. The fixed portion of the spring is disposed about the stem and is in flush contact with the internal surface of the housing.

In another feature, an edge of the spring scrapes the internal surface upon reception into the housing to remove a non-conductive oxide layer formed on the internal surface.

In still another feature, the spring has a coating of conductive material such as tin (Sn).

In yet another feature, the housing and the terminal block are formed of an electrically conductive material.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENT

The following description of the preferred embodiment is merely exemplary in nature and is in no way intended to limit the invention, its application, or uses.

Figure 1:
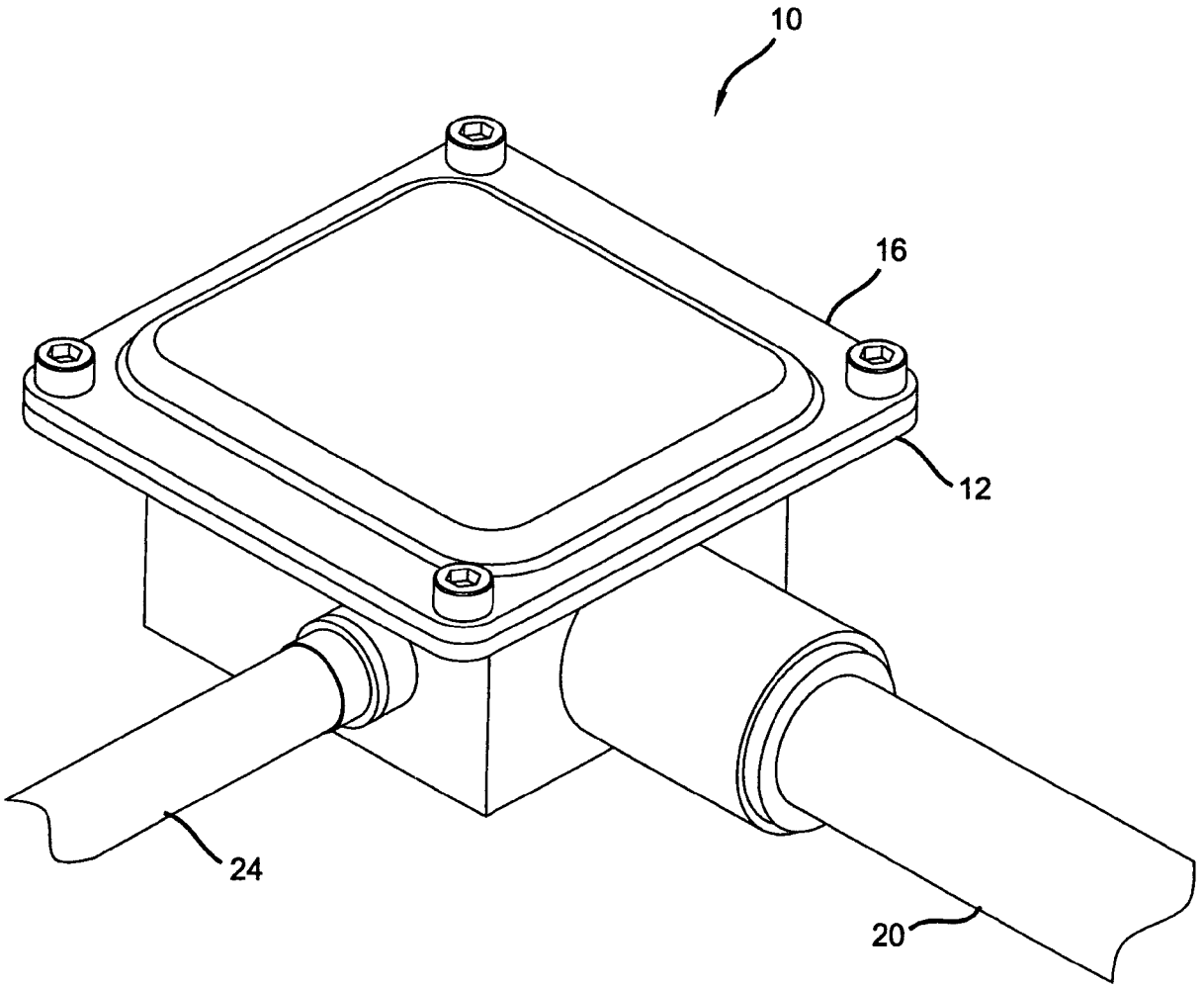
FIG. 1 is a perspective view of a cable housing according to the present invention.

Referring now to FIG. 1, a cable housing 10 is shown. The cable housing 10 includes an electrically conductive housing shell 12 defining a cavity 14. A cover 16 is selectively fixed to the housing shell 12 to cover the cavity 14 and may include a seal (not shown) to provide a sealed environment. Collar 18 extends from the housing shell 12 and receives cable 20. The housing shell 12 also includes terminal aperture 22 into which terminal 24 is received. The terminal 24 is interconnected to the cables 20 within the cavity 14 to provide an electrically conductive path (i.e., continuity) therebetween for grounding the cable shielding with the housing shell 12.

Spacer block 26 seats within the cavity 14. The spacer block 26 includes a main body having a terminal bore 32, an access bore 34 and a stem 36 having a cable bore 38 formed therethrough. Contact spring 50 is received on the end of the stem 36. The stem 36 is pressed into the collar 18 to secure the spacer block 26 within the housing shell 12. Once installed, spacer block 26 tightly fits within cavity 14 to secure block 26 therein.

The contact spring 50 includes an arcuate perimeter portion 52 having a plurality of resilient members or spring tabs 54 extending therefrom. The resilient members 54 extend radially inward relative to the curvature of the arcuate member 52. The contact spring 50 is received onto the stem 36 whereby the arcuate member 52 seat on outer circumferential surfaces 56 of stem 36. The resilient member 54 extends into the cable bore 38 of the stems 36. As the stem 36 is pressed into collar 18 of the housing shell 12, an outside surface 60 and an edge 62 of the arcuate member 52 slides against an internal circumferential surface 64 of the collar 18. The sliding action induces removal of any oxide layer that might exist on the internal circumferential surface 64. In this manner, the outside surface 60 of the arcuate member 52 and the internal surface 64 of the collar 18 are in pressed contact to facilitate an electrically conductive path therebetween.

The contact spring 50 is preferably made of stainless steel. Optionally, the contact spring 50 is coated with an electrically conductive element such as gold (Au) or tin (Sn) and suitable alloys thereof. It is appreciated that other coatings may be used to coat the contact springs 50 for enhanced conductivity.

The cable 20 is received into the housing shell 12 through the collar 18 and the cable bore 38 of the spacer block 26. In a vehicle application, the cable 20 is a high-voltage shielded cables. It is appreciated, however, that the present invention is applicable to a variety of applications including 2 pole and 3 pole high-voltage shielded cables, as well as other shielded cable applications. Cable 20 includes a primary conductor 70 with a terminal end 72 fixed thereto, an internal non-conductive insulating layer 74, a shield ring 76, and an external non-conductive insulating layer 78. The various layers encompassing the primary conductor 70 are stripped in stepped fashion. In this manner, the terminal end 72 is exposed, a length of the internal insulating layer 74 is exposed, and the shield ring 76 is exposed.

Figure 2:
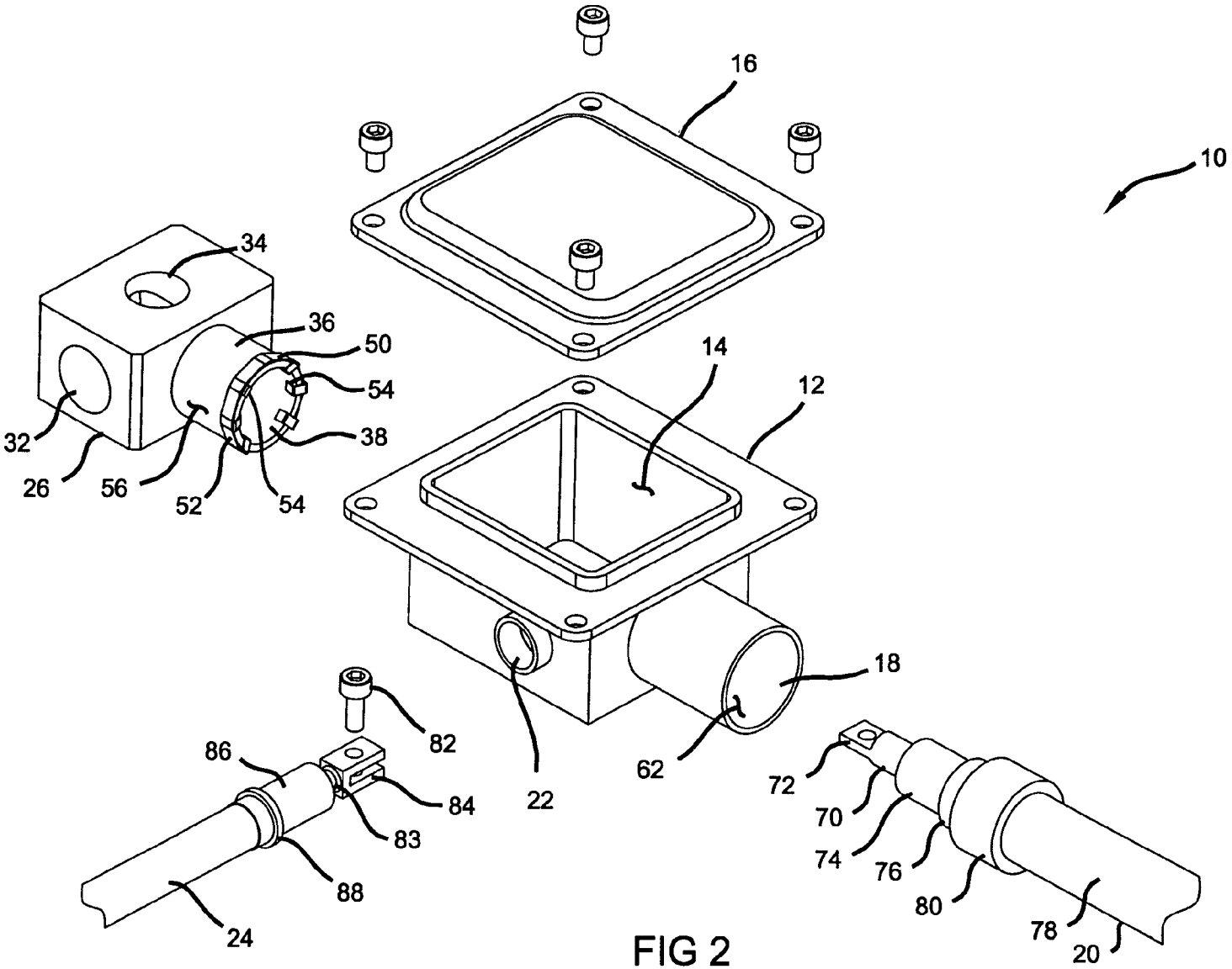
FIG. 2 is an exploded perspective view the cable housing of FIG. 1.
Figure 3:
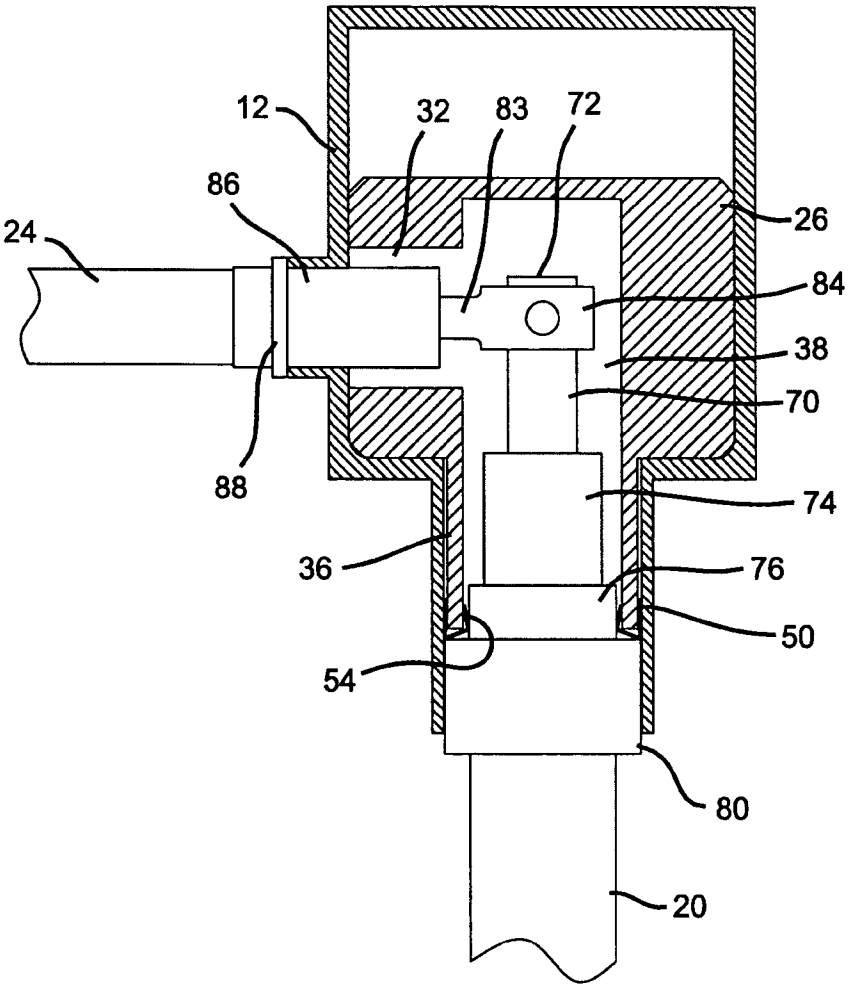
FIG. 3 is a cross-section of a plug-in portion of the cable housing.

With reference to FIGS. 2 and 3, as the cable 20 is inserted into the collar 18 of the housing shell 12 and the cable bore 38 of the spacer block 26, the terminal ends 72 and length of exposed internal insulating layer 74 pass by the resilient member 54 of the contact spring 50 until the exposed shield ring 76 contacts the resilient members 54. Once the exposed shield ring 76 contacts the resilient member 54, the cable 20 is pressed into the housing shell 12 to ensure proper seating. Pressing of the cable 20 urges the exposed shield ring 76 through the contact spring 50 in sliding contact with the resilient member 54 inducing the resilient member 54 to flex radially outward. As a result, the resilient member 54 and the shield ring 76 are in pressed contact to facilitate an electrically conductive path therebetween. In this manner, a conductive path is established between the housing shell 12 and the shield ring 76.

Water and dirt seal 80 can be included to prohibit water and/or dirt from entering the cable housing 10 through the collar 18. The seal 80 is disposed about the cable 20 and is received into the collar 18. The seal 80 can be made of rubber, silicon, or some other resilient material. The seal 80 is pressed into the collar 18 to create a tight seal at the interface between the shell 12 and the seal 80.

The terminal 24 is received into the housing shell 12 through the terminal aperture 22 and terminal bore 32 of the spacer block 26. Terminal 24 includes a conductor 83 with a terminal end 84 fixed thereto, and an external non-conductive insulation layer 86. A seal 88 can be included to prohibit water and/or dirt from entering the cable housing 10 through aperture 22.

The terminal 24 fixedly interconnects with the terminal end 72 of the cable 20. The fixed interconnection between the terminal ends 84 and the terminal end 72 of the cable 20 can be achieved in one of various manners known in the art. For example, a screw 82 can be screwed through respective holes of the terminal 24 and terminal end 72 of the cable 20. The interconnection between the terminal 24 and the cable 20 are accessible through the access bore 34.

The cable housing 10 of the present invention provides a compact, high-voltage electrical connector. The cable housing 10 can be cost-effectively manufactured from a single casting. The collar 18 extending from housing shell 12 also facilitate sealing with the seal 80. Assembly of the cable 20 into the cable housing 10 is a simple plug-in connection, which establishes a shielded connection between the cable 20 and the housing shell 12. The spacer block 26 serves multiple functions, including protecting against cable pull or attachment of a contact rail within the cable housing 10.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electrical connector for a cable of the type having a conductor with a terminal end and a shielding, the electrical connector comprising:

a housing having a first bore extending therethrough and terminating at an interior cavity;

a spacer block disposed within said interior cavity and having a second bore formed therethrough to define a terminal receiving region adapted to receive the terminal end of the cable therein; and a contact spring having a perimeter portion interposed between said housing and said spacer block and a resilient portion extending into said second bore and adapted to provide electrical continuity between the shielding of the cable and said housing, said terminal receiving region being electrically isolated from said contact spring and said housing.

2. The electrical connector of claim 1 further comprising a collar extending from said housing and a stem forward on said spacer block, said collar receiving said stem.

3. The electrical connector of claim 2 wherein said fixed portion of said contact spring is disposed about said stem and is in flush contact with an internal surface of said collar.

4. The electrical connector of claim 1 wherein an edge of said contact spring is in pressed contact with said internal surface upon reception into said housing to scrape a non-conductive oxide layer formed on said internal surface.

5. The electrical connector of claim 1 further comprising a cover overlying said cavity to provide an enclosed interior volume.

6. The electrical connector of claim 1 wherein said contact spring has a coating of conductive material.

7. The electrical connector of claim 6 wherein said conductive material is selected from the group consisting of tin (Sn), gold (Au) and alloys thereof.

8. The electrical connector of claim 1 wherein said spacer block is toned of an electrically non-conductive material.

9. A shielded cable assembly comprising:

a housing having a cavity and a first bore extending through the housing into the cavity;

a spacer block that is disposed within said cavity and has a second bore formed therethrough;

a contact spring having a perimeter portion in contact with said housing and said spacer block and a resilient portion extending into said second bore; and a cable having a conductor with a terminal end, an insulating layer and a shielding layer, said cable inserted into said first and second bores such that said terminal end is electrically isolated within said spacer block and said contact spring provides electrical continuity between said shielding layer and said housing.

10. A shielded cable assembly comprising:

a housing having a first bore extending therethrough and terminating at an interior cavity;

a spacer block disposed within said interior cavity and having a second bore formed therethrough to define a terminal receiving region;

a contact spring having a perimeter portion interposed between said housing and said spacer block and a resilient portion extending into said second bore; and a cable having a conductor with a terminal end, an insulating layer and a shielding layer, said cable inserted into said first and second bores such that said terminal end is electrically isolated within terminal receiving region of said spacer block and said contact spring provides electrical continuity between said shielding layer and said housing.

11. The shielded cable assembly of claim 10 wherein said perimeter portion at least partially surrounds said spacer block.

12. The shielded cable assembly of claim 10 wherein said spacer block further comprises a stem through which said second bore is formed, and wherein said housing includes a collar concentric with said first bore and extending therefrom which receives said stem.

13. The shielded cable assembly of claim 10 wherein an edge of said contact spring is in pressed contact with an internal surface of said housing upon reception into said housing so as to scrape a non-conductive oxide layer formed on said internal surface.

14. The shielded cable assembly of claim 10 further comprising a cover overlying said cavity to provide an enclosed interior volume.

15. The shielded cable assembly of claim 10 wherein said contact spring has a coating of conductive material.

16. The shielded cable assembly of claim 15 wherein said conductive material is selected from the group consisting of tin (Sn), gold (Au) and alloys thereof.

17. The shielded cable assembly of claim 10 wherein said spacer block is formed of an electrically non-conductive material.

* * * * *